US006066019A

United States Patent [19]

Bewlay

[11] Patent Number: 6,066,019

[45] Date of Patent: May 23, 2000

[54] RECRYSTALLIZED CATHODE FILAMENT AND RECRYSTALLIZATION METHOD

[75] Inventor: Bernard Patrick Bewlay, Schenectady, N.Y.

[73] Assignee: General Electric Company, Schenectady, N.Y.

[21] Appl. No.: 09/206,411

[22] Filed: Dec. 7, 1998

[51] Int. Cl.[7] ..... H01J 9/04

[52] U.S. Cl. ..... 445/28; 445/46

[58] Field of Search ..... 445/28, 48, 46

[56] References Cited

U.S. PATENT DOCUMENTS

| | | | |
|---|---|---|---|
| 2,439,913 | 4/1948 | Van Liempt | 445/48 |
| 3,637,374 | 1/1972 | Holzi et al. | 164/46 |
| 3,943,393 | 3/1976 | Naill . | |
| 4,825,123 | 4/1989 | Franzel et al. . | |
| 5,072,147 | 12/1991 | Pugh et al. | 313/341 |
| 5,498,185 | 3/1996 | Knudsen et al. . | |
| 5,515,413 | 5/1996 | Knudsen et al. . | |
| 5,672,085 | 9/1997 | Knudsen et al. . | |
| 5,800,235 | 9/1998 | Ragsdale | 445/48 |

*Primary Examiner*—Kenneth J. Ramsey
*Attorney, Agent, or Firm*—Ernest G. Cusick; Noreen C. Johnson

[57] ABSTRACT

Cathode filaments are recrystallized to a microstructure that maintains ductility for proper alignment and electron emission capability. The method comprises controlled heating of a cathode filament from an ambient temperature $T_{amb}$ to its recrystallization temperature $T_{recryst}$; controlled holding of the cathode filament at the temperature $T_{recryst}$; and controlled cooling of the cathode filament from the temperature $T_{recryst}$ to the ambient temperature $T_{amb}$. The cathode filament is usable in an x-ray tube and can be formed of a tungsten-rhenium material.

28 Claims, 4 Drawing Sheets

RECRYSTALLIZED CATHODE FILAMENT AND RECRYSTALLIZATION METHOD

BACKGROUND OF THE INVENTION

The invention relates to methods of making diagnostic and therapeutic radiology equipment. In particular, the invention relates to recrystallized tungsten-rhenium cathode filaments and cathode filament recrystallization methods. The invention also relates to improved methods for making cathode assemblies and filaments used in x-ray generating equipment, such as, but not limited to, computerized axial tomography (C.A.T.) scanners.

X-rays are produced in a vacuum as electrons are released, accelerated, and then abruptly decelerated or stopped in the target of an x-ray tube. To release electrons, a cathode filament is heated to incandescence (white heat) by passing an electric current through it. The electrons are accelerated by a high voltage, for example in a range from about ten thousand to greater than hundreds of thousands of volts, between the anode (positive) and the cathode (negative). The electrons then impinge on the anode, where they are abruptly slowed down or stopped.

Alignment is important for both x-ray tube focusing and focal spot definition in an x-ray tube. It is important to initially align the filament in the cathode cup assembly during manufacture, and maintain its alignment throughout the manufacturing cycle and operation of the x-ray tube.

Composition, grain microstructure, and recrystallization methods influence a cathode filament's creep behavior, ductility, electron emission, and alignment in an x-ray tube. Cathode filaments are often formed from tungsten materials, such as wires comprising potassium-doped tungsten. The cathode filaments are formed into a desired filament configuration. For example, the cathode filament is formed from a wire with a diameter in a range from about 0.22 mm to about 0.29 mm, for example about 0.25 mm, and formed into a coil having an external diameter of about 0.9 mm. The cathode filament also comprises legs or straight sections that are used for attaching the cathode filament to a cathode cup assembly. The cathode filaments are prepared for x-ray use by a recrystallizing heat treatment, which creates a grain structure that provides creep resistance and promotes ductility and facilitates electron emission.

Cathode filaments have been previously recrystallized after placement in a cathode cup assembly. The cathode filament's legs are inserted into the cathode cup assembly with the coil supported by the stationary legs alone. The recrystallization method comprises passing current through the cathode filament that causes resistive heating (also known as "flashing") of the cathode filament to a temperature of about 2800° C. The resistive heating recrystallizes the coil of the cathode filament, however the legs are not recrystallized due to their positioning in the cathode cup assembly. During the recrystallization, the heated filament, especially at the coil, is subjected to gravitational stresses. The cathode filament will sag and distort in the coil area. Further, when the cathode filament expands upon heating, expansion is constrained by the stationary legs, thus generating stresses and creep strains. Therefore, the cathode filament is moved out of alignment in the x-ray tube.

In resistive heating recrystallization, the cathode filament's temperature is a function of the wire's diameter and the current passed through the cathode filament. Since wire diameters inevitably vary, recrystallization temperatures will vary and can not be accurately controlled. The current carrying capacity of the cathode filament is reduced by leads and welds that are used to attach the cathode filament to the cathode cup assembly. Thus, the cathode filament may not carry sufficient current to be heated to the desired recrystallization temperature, and total recrystallization of the cathode filament will not be achieved.

A cathode filament that has been recrystallized by resistive heating typically becomes mis-aligned as a result of creep deformation. These cathode filaments require re-alignment, re-seating, and re-heating in the cathode cup assembly to provide proper alignment. These re-seating, re-aligning, and re-heating steps may need to be repeated, in some instances up to five times, until a proper alignment is attained. These repeated steps are inefficient, uneconomical, and undesirable.

Therefore, it is desirable to provide a recrystallized cathode filament that maintains its alignment throughout manufacture and use in an x-ray tube. It is also desirable to provide a method for recrystallizing a cathode filament without reducing its low temperature ductility and requiring re-seating, re-aligning, and re-heating steps, as in resistive heating.

SUMMARY OF THE INVENTION

The invention sets forth cathode filaments that are recrystallized. The recrystallization method comprises controlled heating of a tungsten-rhenium cathode filament from an ambient temperature $T_{amb}$ to a heating temperature $T_{heat}$ that is greater than its recrystallization temperature $T_{recryst}$; controlled holding of the cathode filament temperature at the heating temperature $T_{heat}$; and controlled cooling of the cathode filament from the heating temperature $T_{heat}$ to the ambient temperature $T_{amb}$. The cathode filament is usable in an x-ray tube and maintains its ductility and alignment in the x-ray tube.

These and other aspects, advantages and salient features of the invention will become apparent from the following detailed description, which, when taken in conjunction with the annexed drawings, where like parts are designated by like reference characters throughout the drawings, disclose embodiments of the invention.

DESCRIPTION OF THE INVENTION

In the following description of the invention, a cathode filament is described as a tungsten-rhenium, wire, cathode filament. The cathode filament configuration and composition are merely exemplary of cathode filaments within the scope of the invention, and are not meant to limit the invention in any way.

Tungsten-rhenium possesses a higher recrystallization temperature than potassium-doped tungsten(about 2800° C. compared to about 2400° C., respectively), and typically recystallizes to a much smaller (fine) grain size. For example, the grain size of recrystallized potassium-doped tungsten is in a range from about 20 microns to about 125 microns, while the grain size of recrystallized tungsten-rhenium is about 100 microns with a variation of about 25 micorns. Recrystallized tungsten-rhenium is a desirable cathode filament material because its fine grain size provides a high intrinsic low-temperature ductility, for example at room temperature (about 25° C.). This high intrinsic low-temperature ductility enables accurate alignment of a tungsten-rhenium cathode filament alignment in a cathode assembly. Further, tungstenrhenium wire cathode filaments maintain their fine grain size during cathode filament use and thermal cycling of an x-ray tube, in which the maintained fine grain size sustains cathode filament alignment.

Figure 1:
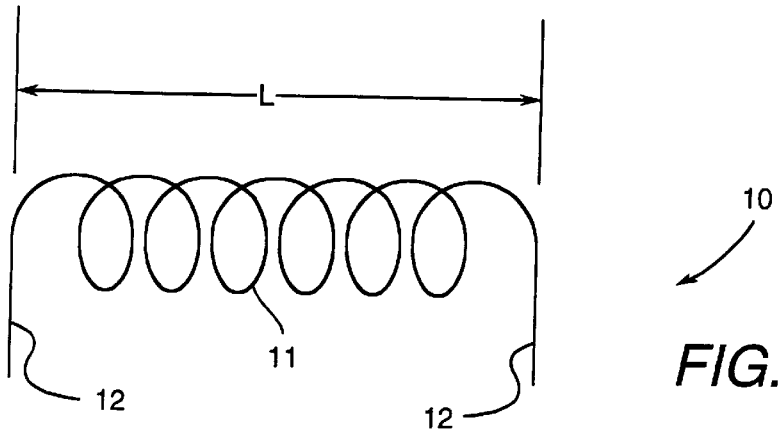
FIG. 1 is a side schematic illustration of a cathode filament.

A wire tungsten-rhenium cathode filament 10 (hereinafter "cathode filament"), as embodied by the invention, is schematically illustrated in FIG. 1. The cathode filament 10 comprises a coil section 11 and legs 12, which extend from the coil section 11. The legs 12 support the cathode filament 10 in a cathode cup assembly (not illustrated), after the cathode filament 10 is recrystallized and inserted into the cathode cup assembly. The cathode filament is formed from a wire with a diameter in a range from about 0.2 mm to about 0.3 mm. For example, the cathode filament is formed from a wire with a diameter in a range form about 0.22 mm to about 0.29 mm, such as a diameter of about 0.25 mm. The cathode filament is formed into a coil having an external diameter of about 0.9 mm.

Figure 2:
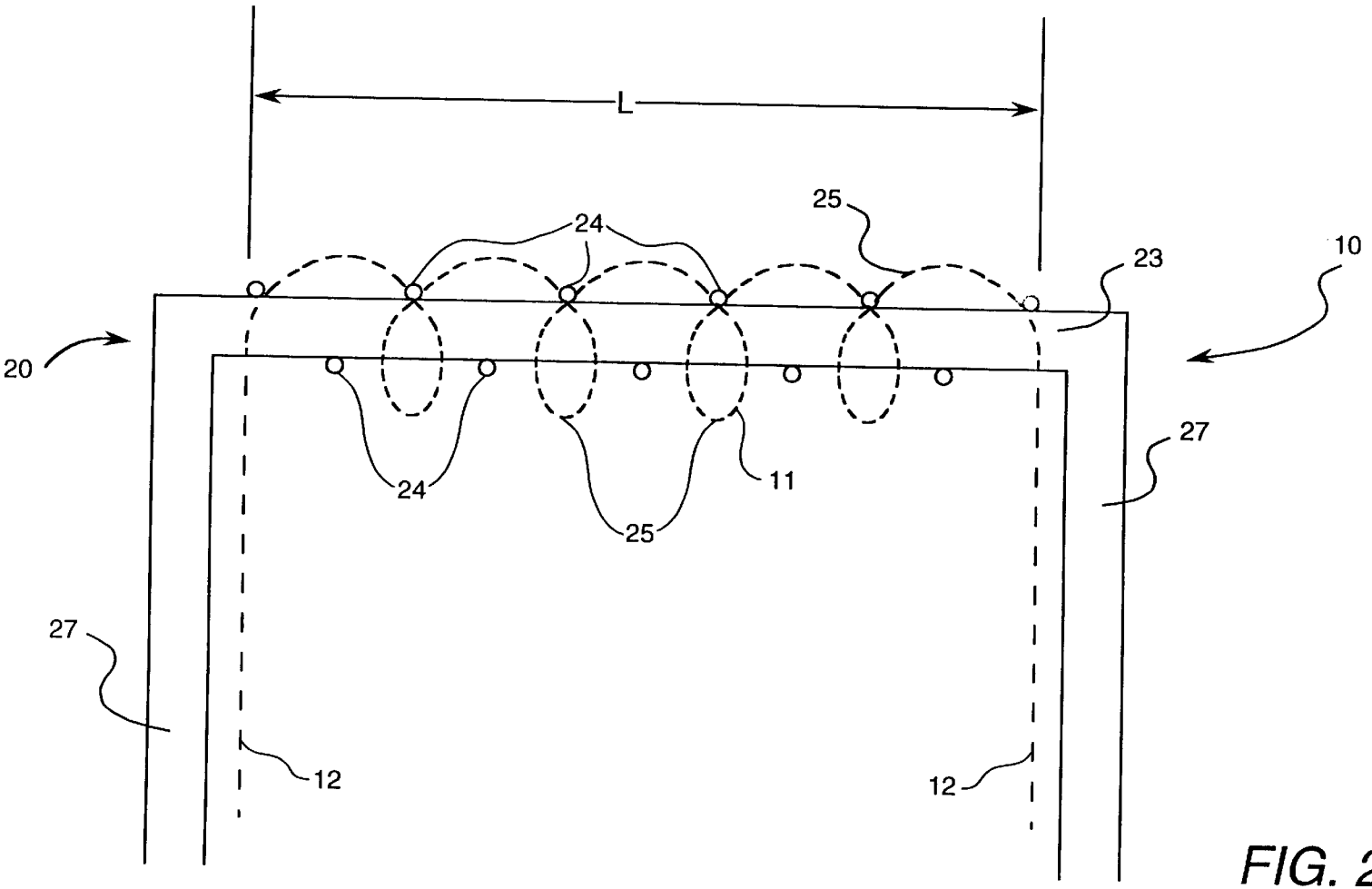
FIG. 2 is a side schematic illustration of a cathode filament disposed in a support device.

During the recrystallization methods, as embodied by the invention, the cathode filaments 10 are loaded onto a support device 20 and supported over their length l. The support device 20 is schematically illustrated in FIG. 2, with the cathode filament 10 illustrated in phantom. The support device 20 supports the cathode filament 10 to minimize creep deformation, stresses, and elastic strains caused by its expansion during recrystallization. The support device 20 (also known in the art as a "boat") comprises a body 21 formed of a tungsten material. The body 21 can support the tungsten-rhenium cathode filament, for example by having the cathode filament disposed thereon. Alternatively, the body 21 can comprise a mandrel 23 that is connected to the body 21. The mandrel 23 supports the coil section 11 during recrystallization. The mandrel 23 can be formed by a wire that is coiled. The mandrel wire coils comprise alternating peaks 24 and depressions 25 that are adapted to support individual coils of the coil section 11. This support minimizes cathode filament creep deformation during high temperature exposure or recrystallization. The support device 20 may also comprise side supports 27 for supporting the legs 12 of the cathode filament 10. The side supports 27 do not constrain expansion of the legs 12 and other parts of the cathode filament 10.

The recrystallization method, as embodied by the invention, comprises controlled heating, controlled holding, and controlled cooling steps. These steps are conducted in a furnace prior to insertion of the tungsten-rhenium cathode filament in a cathode cup assembly. The furnace heats the tungsten-rhenium cathode filament to an even heating temperature $T_{heat}$ above the tungsten-rhenium recrystallization temperature $T_{recryst}$. The cathode filaments are evenly heated and recrystallized by external heat that is applied to the entire cathode filament. The cathode filaments are free to expand during recrystallization. The cathode filament's temperature is controlled by the furnace's temperature, and is not dependent on the cathode filament's structure or its current carrying ability as in resistive heating methods. The furnace can provide a reducing atmosphere, for example a hydrogen-containing atmosphere, to prevent oxidation of the cathode filament.

The recrystallization method, as embodied by the invention, provides enhanced retention of cathode filament geometry during recrystallization. The support device 20 supports cathode filaments of various sizes, diameters, configurations, structures, and compositions. Any stresses, elastic strains, creep deformation, and other adverse forces on the cathode filament 10 are minimized since expansion is un-constrained and creep deformation is minimized by the support device 20. Therefore, the re-aligning, re-seating, and re-crystallization steps often associated with resistive heating recrystallization are not needed with the recrystallization method, as embodied by the invention.

The recrystallization method recrystallizes the cathode filament, including the cathode filament's coil section 11 and legs 12, to a uniform fine grain size of about 100 microns with a variation of about 25 microns. The uniform fine grain size provides low-temperature ductility to the recrystallized tungsten-rhenium cathode filament. The recrystallization method is not limited to a cathode filaments that fit into a cathode cup assembly; any cathode filament configuration is within the scope of the invention.

The cathode filament recrystallization method, as embodied by the invention, includes batch and stoking recrystallization methods. In a batch recrystallization method, a cathode filament is placed in furnace. The furnace is initially heated to a heating temperature $T_{heat}$. The cathode filament is heated when placed in the furnace from an ambient temperature $T_{amb}$ to the heating temperature $T_{heat}$ that is above tungsten-rhenium's recrystallization temperature $T_{recryst}$. Alternatively, the furnace in a batch recrystallization method can be unheated, and both the furnace and cathode filament are controllably heated from an ambient temperature $T_{amb}$ to the heating temperature $T_{heat}$ above its recrystallization temperature $T_{recryst}$.

The recrystallization method also includes a stoking recrystallization method. In a stoking recrystallization method, a cathode filament moves into, through, and out of a furnace. The furnace temperature in a stoking recrystallization method gradually rises from temperature $T_{amb}$ to temperature $T_{heat}$, remains steady at temperature $T_{heat}$, gradually falls from temperature $T_{heat}$ to temperature $T_{amb}$ in different furnace zones. The cathode filament is recrystallized as it moves inside the furnace. The stoking recrystallization method is described in further detail with respect to FIG. 5.

Figure 3:
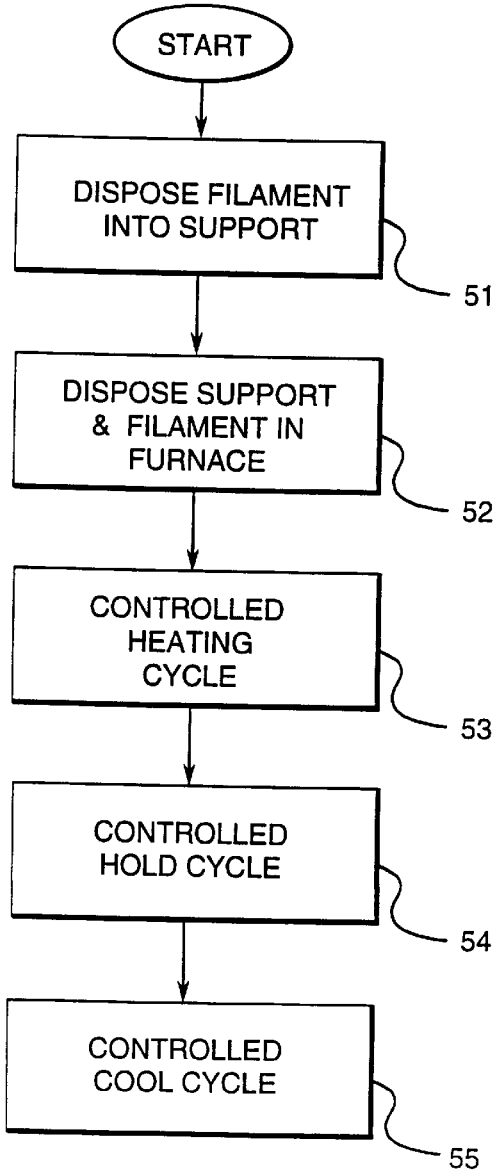
FIG. 3 is a flow chart of a cathode filament recrystallization method.
Figure 4:
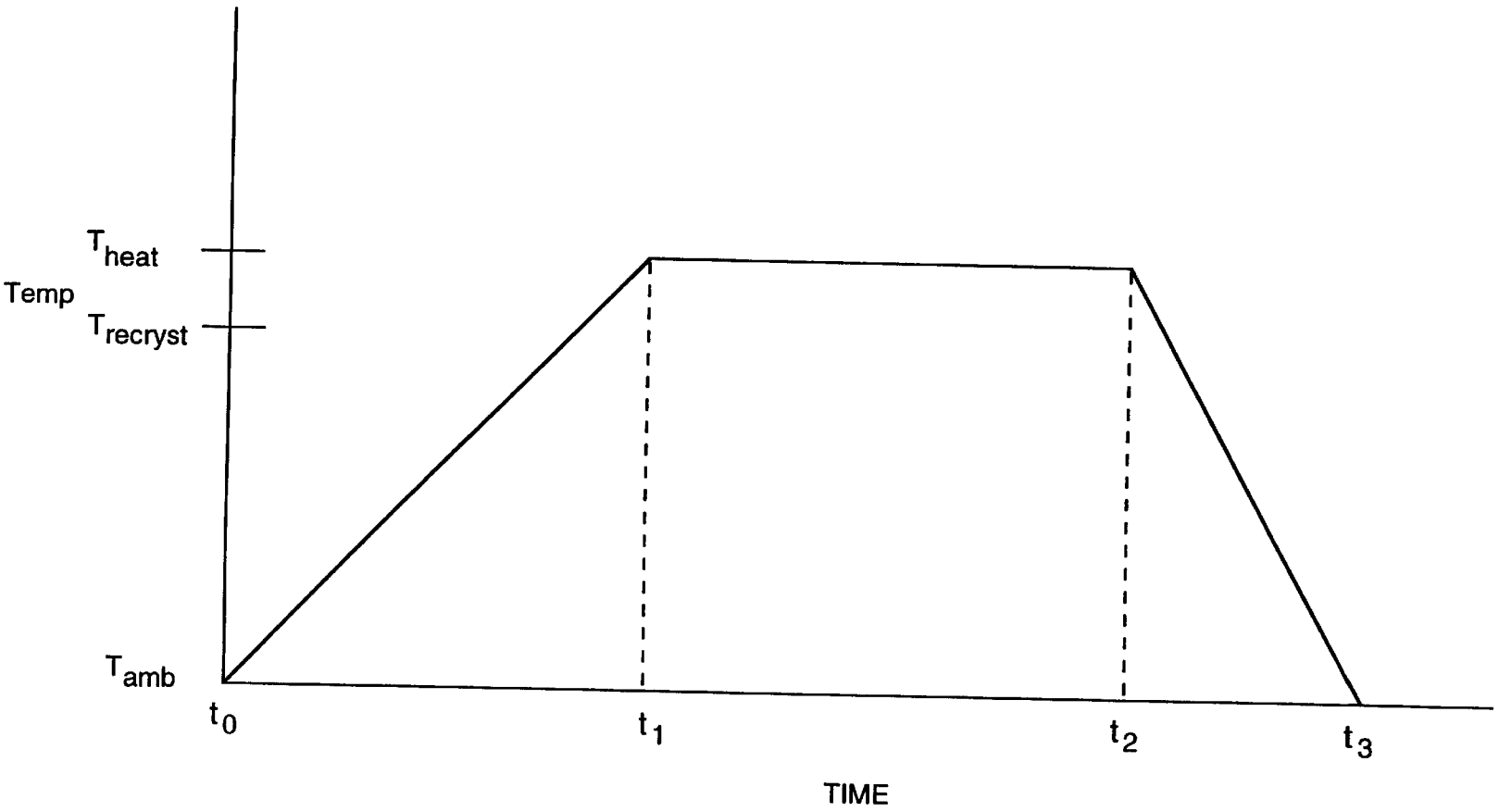
FIG. 4 is a graph of cathode filament temperature versus time for a recrystallization method.

The recrystallization method will now be discussed with reference to the flowchart of FIG. 3 and the graph of temperature versus time in FIG. 4. The figures are applicable to both stoking and batch recrystallization methods, however a batch method will be described as an exemplary recrystallization method. In the following description of the method, the times, rates, and temperature are approximate. Also, the following description refers to a tungsten-rhenium cathode filament loaded into a support device 20, however any number of tungsten-rhenium cathode filaments of any configuration and composition may be loaded on the support device 20. This description is merely exemplary and is not meant to limit the invention in any way.

In step S1, a tungsten-rhenium cathode filament is placed in a support device 20. The support device 20 and the tungsten-rhenium cathode filament 10 are disposed in a furnace, in step S2, at time t0 and with the tungsten-rhenium cathode filament at an ambient temperature $T_{amb}$.

If the recrystallization method comprises a batch recrystallization method, the supporting device 20 is placed entirely in a furnace with controlled heating. A controlled heating step S3 occurs in a controlled heating cycle from time t0 to time t1. The cathode filament 10 is heated from temperature $T_{amb}$ to a furnace temperature $T_{heat}$, for example less than and up to about 3200° C., which is above the tungsten-rhenium recrystallization temperature $T_{recryst}$ (about 2600° C.). The controlled heating cycle is in a range of about 30 minutes to about 24 hours. Thus, a controlled heating rate includes rates from about 1° C./minute to about 60° C./minute.

The cathode filament 10 is held at temperature $T_{heat}$ in a controlled holding step S4 for a controlled holding cycle from time t1 to time t2. The controlled holding cycle is in a range from about 1 minute to about 10 hours. The cathode filament 10, including coils 11 and legs 12, is held at an essentially uniform, constant temperature $T_{heat}$ during the controlled holding step S4 to recrystallize the cathode filament 10.

After the controlled holding step S4, the cathode filament is subject to a controlled cooling step S5. The controlled cooling step S5 occurs from time t2 to time t3. The controlled temperature during the controlled cooling step S5 is controllably decreased from about temperature $T_{heat}$ to about temperature $T_{amb}$. A cooling rate during the controlled cooling step S5 can be faster than the heating rate. For example, the cooling rate includes a cooling rate in a range from about 10° C./minute to about 300° C./minute. Thus, a controlled cooling cycle occurs in a range of about 7 hours to about 10 minutes.

Figure 5:
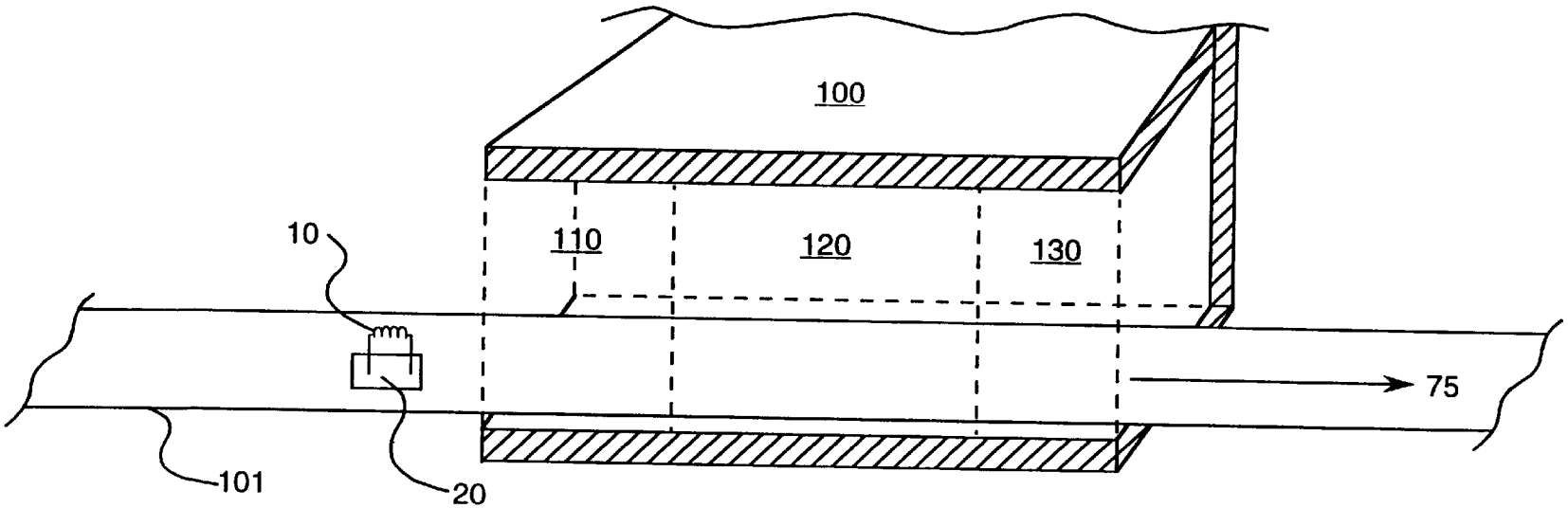
FIG. 5 is a side, part-sectional, schematic view illustration of a stoking furnace system.

If the recrystallization method comprises a stoking recrystallization method, the tungsten-rhenium cathode filament 10 and supporting device 20 moves into, through, and out of a stoking furnace 100. FIG. 5 schematically illustrates a furnace 100 for a stoking recrystallization method. The temperature of the furnace 100 is gradually increased in furnace zone 110 from temperature $T_{amb}$ to the heating temperature $T_{heat}$. The controlled temperature in furnace zone 120 is held at about temperature $T_{heat}$. The temperature in the furnace zone 130 gradually decreases from temperature $T_{heat}$ to about temperature $T_{amb}$.

In the stoking recrystallization method, the tungsten-rhenium cathode filament 10 is moved by a motive device 101 through the furnace 100 in direction 75. As the cathode filament 10 moves, it is subjected to the controlled heating step S3 in furnace zone 110. In the furnace zone 110, the cathode filament temperature is raised from about temperature $T_{amb}$ to about temperature $T_{heat}$ over time t0 to time t1. The cathode filament 10 then moves through furnace zone 120, where the controlled temperature $T_{heat}$ is held essentially constant from time t1 to time t2 during the controlled holding step S4. The tungsten-rhenium cathode filament undergoes recrystallization in furnace zone 120 as the temperature $T_{heat}$ is above the recrystallization temperature $T_{recryst}$ for tungsten-rhenium. The cathode filament 10 then moves into furnace zone 130, where it is cooled from time t2 to time t3 in the controlled cooling step S5. The temperature is cooled from about temperature $T_{heat}$ tO about temperature $T_{amb}$.

An x-ray tube can be formed by recrystallizing a cathode filament and disposing the recrystallized cathode filament in a cathode cup assembly. The cathode filament recrystallizion follows the method discussed above, including the controlled heating, controlled holding, and controlled cooling. The x-ray tube forming will not require additional steps of re-seating, re-aligning, and re-heating of the cathode filament. These steps are not needed since the recrystallization method, as embodied by the invention, provides a tungsten-rhenium cathode filament with a microstructure that possesses sufficient low temperature ductility to be properly aligned in an x-ray tube at the time of initial placement.

While various embodiments are described herein, it will be appreciated from the specification that various combinations of elements, variations or improvements therein may be made by those skilled in the art, and are within the scope of the invention.

I claim:

1. A method of recrystallizing a tungsten-rhenium cathode filament, the tungsten-rhenium cathode filament possessing a recrystallization temperature $T_{recryst}$, the method comprising:

controllably gradually heating a cathode filament from about an ambient temperature $T_{amb}$ and continuously increasing to about a heating temperature $T_{heat}$, the heating temperature $T_{heat}$ being greater than the recrystallization temperature $T_{recryst}$;

controllably holding the tungsten-rhenium cathode filament at about the heating temperature $T_{heat}$; and controllably cooling the tungsten-rhenium cathode filament from about the heating temperature $T_{heat}$ to about the ambient temperature $T_{amb}$.

2. A method according to claim 1, wherein the heating temperature $T_{heat}$ is less than about 3200° C.

3. A method according to claim 1, wherein the ambient temperature $T_{amb}$ is about 25° C.

4. A method according to claim 1, wherein the step of controlled heating of the tungsten-rhenium cathode filament occurs over a time period from about 30 minutes to about 24 hours.

5. A method according to claim 1, wherein the step of controlled heating of the tungsten-rhenium cathode filament comprises a controlled heating rate in a range from about 1° C./minute to about 30°C./minute.

6. A method according to claim 1, wherein the step of holding comprises holding the heating temperature $T_{heat}$ for a period of time from about 1 minute to about 10 hours.

7. A method according to claim 1, wherein the step of controlled cooling of the cathode filament occurs over a time period from about 10 minutes to about 7 hours.

8. A method according to claim 1, wherein the step of controlled cooling of the tungsten-rhenium cathode filament comprises a controlled cooling rate from about 10° C./minute to about 300° C./minute.

9. A method according to claim 1, further comprising a step of disposing the tungsten-rhenium cathode filament on a support device prior to the step of controlled heating of the cathode filament.

10. A method according to claim 9, wherein the tungsten-rhenium cathode filament comprises a coil section and legs, the support device is capable of supporting the coil section and the legs of the cathode filament to minimize creep deformation, stresses, and elastic strains on the cathode filament during the recrystallization process.

11. A method according to claim 1, the method further comprising a step of moving the tungsten-rhenium cathode filament through a furnace.

12. A method according to claim 11, wherein the step of moving the cathode filament through a furnace comprises:

moving the cathode filament through a first furnace zone in which a temperature gradually rises from the ambient temperature $T_{amb}$ to the heating temperature $T_{heat}$ so the cathode filament is heated in a controlled manner;

moving the cathode filament through a second furnace zone in which the heating temperature $T_{heat}$ remains essentially constant; and moving the cathode filament through a third furnace zone in which the temperature gradually decreases from the heating temperature $T_{heat}$ to the ambient temperature $T_{amb}$ so the cathode filament is cooled in a controlled manner.

13. A method according to claim 12, wherein the step of moving the tungsten-rhenium cathode filament through a furnace further comprises loading the cathode filament on a support device and moving the support device and tungsten-rhenium cathode filament through the furnace.

14. A tungsten-rhenium cathode filament recrystallized by the method of claim 1.

15. A method of forming an x-ray tube, the method comprising:

recrystallizing a tungsten-rhenium cathode filament, the tungsten-rhenium cathode filament possessing a recrystallization temperature $T_{recryst}$; and disposing the recrystallized tungsten-rhenium cathode filament in a cathode cup assembly;

the recrystallizing of the tungsten-rhenium cathode filament comprises:

controlled heating of the cathode filament from about an ambient temperature $T_{amb}$ to a heating temperature $T_{heat}$, the heating temperature $T_{heat}$ being greater than the tungsten-rhenium recrystallization temperature $T_{recryst}$;

controlled holding of the tungsten-rhenium cathode filament at the heating temperature $T_{heat}$; and controlled cooling of the tungsten-rhenium cathode filament from the heating temperature $T_{heat}$ to the ambient temperature $T_{amb}$.

16. A method according to claim 15, wherein the heating temperature $T_{heat}$ is less than about 3200° C.

17. A method according to claim 15, wherein the step of controlled heating of the tungsten-rhenium cathode filament occurs over a time period from about 30 minutes to about 24 hours.

18. A method according to claim 15, wherein the step of controlled heating of the tungsten-rhenium cathode filament comprises a controlled heating rate from about 1° C./minute to about 30° C./minute.

19. A method according to claim 15, wherein the step of holding comprises holding the heating temperature $T_{heat}$ for a period of time from about 1 minute to about 10 hours.

20. A method according to claim 15, wherein the step of controlled cooling of the tungsten-rhenium cathode filament occurs over a time period from about 10 minutes to about 7 hours.

21. A method according to claim 15, wherein the step of controlled cooling of the tungsten-rhenium cathode filament comprises a controlled cooling rate from about 10° C./minute to about 300° C./minute.

22. A method according to claim 15, further comprising a step of disposing the tungsten-rhenium cathode filament on a support device prior to the step of controlled heating of the tungsten-rhenium cathode filament.

23. A method according to claim 22, wherein the tungsten-rhenium cathode filament comprises a coil section and legs, the support device is capable of supporting the coil section and the legs of the cathode filament to minimize creep deformation, stresses, and elastic strains on the tungsten-rhenium cathode filament during recrystallization.

24. A method according to claim 15, the method further comprising a step of moving the tungsten-rhenium cathode filament through a furnace.

25. A method according to claim 24, wherein the step of moving the tungsten-rhenium cathode filament through a furnace comprises:

moving the tungsten-rhenium cathode filament through a first furnace zone in which a temperature gradually rises from the ambient temperature $T_{amb}$ to about the heating temperature $T_{heat}$ so the tungsten-rhenium cathode filament is heated in a controlled manner;

moving the tungsten-rhenium cathode filament through a second furnace zone in which heating temperature $T_{heat}$ remains essentially constant; and moving the tungsten-rhenium cathode filament through a third furnace zone in which the temperature gradually decreases from the heating temperature $T_{heat}$ to the ambient temperature $T_{amb}$ so the tungsten-rhenium cathode filament is cooled in a controlled manner.

26. A method according to claim 25, wherein step of moving the tungsten-rhenium cathode filament through a furnace further comprises loading the tungsten-rhenium cathode filament on a support device and moving the support device and tungsten-rhenium cathode filament through the furnace.

27. A method according to claim 15, wherein the ambient temperature $T_{amb}$ is about 25° C.

28. An x-ray tube formed by the method of claim 15.

* * * * *